US009463914B2

(12) United States Patent
Andochick

(10) Patent No.: US 9,463,914 B2
(45) **Date of Patent: *Oct. 11, 2016**

(54) METHOD AND APPARATUS FOR MATERIAL STORAGE AND TRANSPORT

(76) Inventor: Scott E. Andochick, Potomac, MD (US)

( * ) Notice: Subject to any disclaimer, the term of this patent is extended or adjusted under 35 U.S.C. 154(b) by 993 days.

This patent is subject to a terminal disclaimer.

(21) Appl. No.: 12/543,040

(22) Filed: Aug. 18, 2009

(65) Prior Publication Data

US 2010/0254633 A1 Oct. 7, 2010

Related U.S. Application Data

(63) Continuation-in-part of application No. 12/416,561, filed on Apr. 1, 2009, now Pat. No. 8,672,544.

(51) Int. Cl.

| | |
|---|---|
| ***B65D 75/42*** | (2006.01) |
| ***B65D 73/02*** | (2006.01) |
| ***B65D 75/48*** | (2006.01) |
| ***B65D 75/52*** | (2006.01) |
| ***B65D 75/56*** | (2006.01) |
| ***B65D 77/28*** | (2006.01) |

(52) U.S. Cl.

CPC ..... *B65D 75/42* (2013.01); *B65D 73/02* (2013.01); *B65D 75/48* (2013.01); *B65D 75/527* (2013.01); *B65D 75/56* (2013.01); *B65D 77/28* (2013.01)

(58) Field of Classification Search

CPC .. B65D 33/10; B65D 33/105; B65D 33/122; B65D 33/14; B65D 31/12; B65D 88/1681; B65D 88/1612; B65D 88/1668; B65D 88/1687; B65D 75/42; B65D 75/48; B65D 75/527; B65D 75/56; B65D 73/02; B65D 77/28

USPC ..... 383/37, 119, 566, 38–40, 6, 7, 17, 18, 383/22, 24, 207–209; 220/666, 754; 224/148.1–148.7

See application file for complete search history.

(56) References Cited

U.S. PATENT DOCUMENTS

| | | | | | |
|---|---|---|---|---|---|
| 747,634 | A | * | 12/1903 | Peterson | 383/38 |
| 1,603,001 | A | * | 10/1926 | Carter | 607/108 |
| 1,650,764 | A | * | 11/1927 | Marin | 224/148.1 |
| 2,194,451 | A | | 3/1940 | Soubier | |
| 2,220,873 | A | * | 11/1940 | Waters | 383/108 |
| 2,647,680 | A | * | 8/1953 | Vogt | 383/22 |
| 2,934,122 | A | * | 4/1960 | Lindsey | 383/22 |

(Continued)

FOREIGN PATENT DOCUMENTS

| | | |
|---|---|---|
| IT | 12418998 | 2/1994 |
| WO | WO2007059643 | 5/2007 |

OTHER PUBLICATIONS www.prolitegear.com, Hydration products pages, Feb. 1, 2004 according to www.archive.org.

*Primary Examiner* — Peter Helvey

(74) *Attorney, Agent, or Firm* — Leveque Intellectual Property Law, P.C.

(57) ABSTRACT

An apparatus for material storage and transport uses one or more bags, each constructed from one of more flexible plastic sheets and forming a chamber for holding material. A bag may be coupled to an adjacent bag by at least one strip of flexible material, which may optionally be perforated to allow adjacent bags to be separated from one another. Multiple bags may be arranged side-by-side, or end-to-end, in a line. The ends of the line may be removably coupled to one another to form a loop.

18 Claims, 7 Drawing Sheets

(56) References Cited

U.S. PATENT DOCUMENTS

| | | | | | |
|---|---|---|---|---|---|
| 3,008,835 | A | | 11/1961 | Madding | |
| 3,030,003 | A | | 4/1962 | Schanzle | |
| 3,231,901 | A | * | 2/1966 | Kennedy | 604/322 |
| 3,358,821 | A | | 12/1967 | Weisberg | |
| 3,490,576 | A | * | 1/1970 | Alessi et al. | 206/749 |
| 3,537,628 | A | * | 11/1970 | Thompson | 224/609 |
| 3,559,874 | A | * | 2/1971 | Titchenal | 229/69 |
| 3,669,276 | A | * | 6/1972 | Woods | 211/34 |
| 3,674,135 | A | * | 7/1972 | Simon | 206/225 |
| 3,779,449 | A | * | 12/1973 | Membrino | 383/35 |
| 3,791,573 | A | * | 2/1974 | Titchenal et al. | 229/69 |
| 3,809,224 | A | | 5/1974 | Greenwood | |
| 4,090,650 | A | * | 5/1978 | Gotta | 224/148.2 |
| 4,139,130 | A | * | 2/1979 | Glusker et al. | 224/148.2 |
| 4,176,772 | A | * | 12/1979 | Danon | 224/148.5 |
| 4,265,381 | A | * | 5/1981 | Muscatell | 224/148.5 |
| 4,433,783 | A | * | 2/1984 | Dickinson | 206/484 |
| 4,566,507 | A | * | 1/1986 | Rauchwerger | 141/271 |
| 4,598,421 | A | * | 7/1986 | Jostler | 383/37 |
| 4,634,031 | A | * | 1/1987 | Frankhouse | 224/602 |
| 4,685,148 | A | | 8/1987 | Titchenal | |
| 4,733,817 | A | * | 3/1988 | Makowka | 229/69 |
| 4,768,688 | A | * | 9/1988 | Harrigan | 224/148.2 |
| 4,793,533 | A | * | 12/1988 | Yang | 224/148.2 |
| 4,813,792 | A | | 3/1989 | Belmont et al. | |
| 4,818,544 | A | * | 4/1989 | Seward | 426/77 |
| D302,874 | S | * | 8/1989 | Bossart | D21/805 |
| 4,863,285 | A | | 9/1989 | Claxton | |
| D304,546 | S | * | 11/1989 | Cattach | D9/708 |
| 4,911,562 | A | * | 3/1990 | Mazzeschi | 383/16 |
| 4,943,168 | A | * | 7/1990 | Berg et al. | 383/38 |
| 4,951,940 | A | * | 8/1990 | Vitello et al. | 482/105 |
| 4,988,097 | A | * | 1/1991 | Smith et al. | 482/105 |
| 5,074,300 | A | * | 12/1991 | Murphy | 607/108 |
| 5,107,859 | A | * | 4/1992 | Alcorn et al. | 128/853 |
| 5,112,138 | A | * | 5/1992 | Peppiatt | 383/29 |
| 5,115,947 | A | * | 5/1992 | McDonnell et al. | 222/107 |
| 5,121,995 | A | * | 6/1992 | Newman et al. | 383/29 |
| 5,131,553 | A | * | 7/1992 | Geasland | 220/235 |
| 5,167,354 | A | * | 12/1992 | Cohanfard | 224/148.2 |
| 5,188,266 | A | * | 2/1993 | Loulias | 224/148.6 |
| 5,207,362 | A | * | 5/1993 | Janus et al. | 224/148.2 |
| D340,582 | S | * | 10/1993 | Pressentin | D3/229 |
| 5,282,557 | A | * | 2/1994 | McCook | 224/148.2 |
| 5,282,687 | A | * | 2/1994 | Yee | 383/25 |
| D352,359 | S | * | 11/1994 | Vorhis | D24/207 |
| 5,377,833 | A | * | 1/1995 | Ranger | 206/430 |
| 5,431,308 | A | * | 7/1995 | Tchen | 222/175 |
| 5,571,260 | A | | 11/1996 | Krug | |
| 5,595,069 | A | * | 1/1997 | Gies | 62/530 |
| D378,022 | S | * | 2/1997 | Chen | D3/229 |
| 5,732,862 | A | * | 3/1998 | Bull | 224/217 |
| 5,759,569 | A | * | 6/1998 | Hird et al. | 424/443 |
| D396,630 | S | * | 8/1998 | Lerner | D9/709 |
| 5,971,613 | A | * | 10/1999 | Bell | 383/107 |
| 5,979,707 | A | * | 11/1999 | Bodin et al. | 222/95 |
| 5,984,145 | A | * | 11/1999 | McAllister | 222/175 |
| 5,996,800 | A | * | 12/1999 | Pratt | 206/524.8 |
| 6,000,848 | A | * | 12/1999 | Massioui | 383/80 |
| 6,004,033 | A | * | 12/1999 | Cirone | 383/24 |
| 6,076,967 | A | * | 6/2000 | Beaudette | 383/41 |
| 6,176,394 | B1 | * | 1/2001 | Shimko et al. | 222/92 |
| 6,422,753 | B1 | * | 7/2002 | Thomas | 383/209 |
| 6,586,060 | B2 | * | 7/2003 | Kose et al. | 428/35.2 |
| 6,598,770 | B2 | * | 7/2003 | Bolts | 224/148.2 |
| 6,619,843 | B2 | * | 9/2003 | Harmanoglu | 383/84 |
| 6,626,333 | B2 | * | 9/2003 | Levesque et al. | 224/148.6 |
| 6,669,016 | B1 | * | 12/2003 | Carson | 206/278 |
| 6,695,757 | B2 | * | 2/2004 | Edwards et al. | 493/51 |
| 6,805,261 | B1 | * | 10/2004 | Laudenberg | 222/107 |
| 6,837,472 | B1 | * | 1/2005 | Beutz | 248/312 |
| 6,880,714 | B2 | * | 4/2005 | Blanchester | 215/399 |
| D517,314 | S | * | 3/2006 | Moyer | D3/229 |
| 7,036,986 | B2 | * | 5/2006 | Matsuda et al. | 383/38 |
| 7,160,028 | B1 | * | 1/2007 | Linday | 383/4 |
| 7,284,681 | B2 | * | 10/2007 | Hagihara | 222/107 |
| 7,329,069 | B2 | * | 2/2008 | Slater et al. | 405/114 |
| 7,357,276 | B2 | * | 4/2008 | Savage et al. | 222/92 |
| D573,037 | S | * | 7/2008 | Murray | D9/710 |
| D580,749 | S | * | 11/2008 | Miller | D9/416 |
| D580,782 | S | * | 11/2008 | Murray | D9/707 |
| 7,810,667 | B2 | | 10/2010 | Douglas et al. | |
| 2001/0005435 | A1 | * | 6/2001 | Harmanoglu | 383/84 |
| 2002/0176639 | A1 | * | 11/2002 | Crawley | 383/33 |
| 2003/0102239 | A1 | | 6/2003 | Beard | |
| 2005/0061831 | A1 | * | 3/2005 | Brown et al. | 222/107 |
| 2005/0063618 | A1 | * | 3/2005 | Lorsch | 383/38 |
| 2005/0189385 | A1 | * | 9/2005 | Dreyer et al. | 224/148.7 |
| 2005/0265636 | A1 | * | 12/2005 | Michalsky | 383/104 |
| 2006/0233467 | A1 | * | 10/2006 | Mize, Jr. | 383/37 |
| 2006/0255006 | A1 | * | 11/2006 | Wagenknecht et al. | 215/396 |
| 2007/0095831 | A1 | * | 5/2007 | Thatcher | 220/212.5 |
| 2007/0108238 | A1 | * | 5/2007 | Kirker | 224/148.2 |
| 2007/0140597 | A1 | * | 6/2007 | Ozdeger Donovan et al. | 383/14 |
| 2008/0226200 | A1 | * | 9/2008 | Murray | 383/7 |
| 2010/0032458 | A1 | * | 2/2010 | Shitaye | 224/148.2 |
| 2010/0086239 | A1 | * | 4/2010 | Latour | 383/38 |
| 2010/0159096 | A1 | * | 6/2010 | Sam | 426/394 |
| 2010/0192998 | A1 | * | 8/2010 | Villers et al. | 135/96 |
| 2010/0252562 | A1 | * | 10/2010 | Andochick | 220/666 |
| 2010/0254633 | A1 | * | 10/2010 | Andochick | 383/37 |

* cited by examiner

METHOD AND APPARATUS FOR MATERIAL STORAGE AND TRANSPORT

PRIORITY CLAIM AND NOTICE

This application is a continuation in part of U.S. patent application Ser. No. 12/416,561 filed Apr. 1, 2009, entitled "Method and Apparatus for Water Storage and Transport", which is hereby incorporated herein by reference.

BACKGROUND

Commonly, potable water is distributed to the consumer in plastic or glass bottles of various sizes and shapes, whereas ice is distributed in blocks or in individual plastic bags.

Distribution of water in bottles has a number of disadvantages. Firstly, when the bottles are empty they tend to retain their shape, thus creating a large volume of waste material. Secondly, bottles tend to crack or split if the water in them is frozen, since water expands as it cools. Bottles are therefore not suited to the distribution of ice.

In some situations, such as when emergency relief is needed at a particular location, there is often a need for both ice and water. Ice may be needed for a variety of purposes, included the preservation of perishable foods and for personal cooling, while water is required for hydration. In such situations, those seeking relief must carry unwieldy containers of water (either large containers or multiple bottles) as well as bags or blocks of ice.

There is also a need to transport and store other materials, such as other liquids and solids, in both frozen and non-frozen states in a manner that is efficient, doesn't take much room and is versatile.

BRIEF DESCRIPTION OF THE FIGURES

The accompanying figures, in which like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
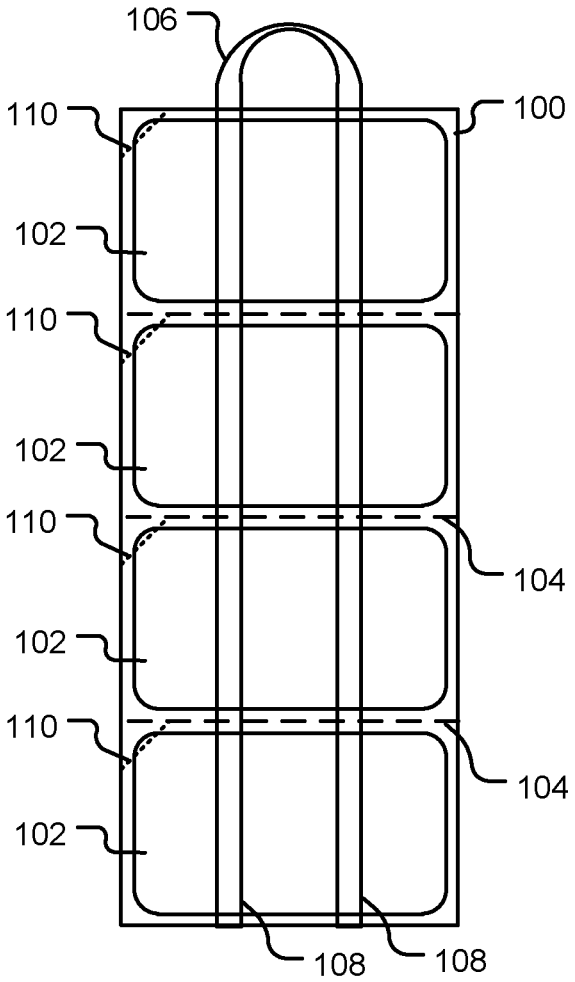
FIG. 1 is a first view of an exemplary container in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to material (frozen or liquid) storage and transport. Accordingly, the apparatus components and method steps have been represented, where appropriate, by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 is a first view of an exemplary apparatus for material storage and transport in accordance with some embodiments of the invention. As used herein, the term material encompasses a variety of substances, and includes, but is not limited, to liquid, non-liquid or solid material, frozen or non-frozen, re-usable material, potable liquids and food suitable for human and animal consumption. Material as used herein thus may include liquid water or frozen water; liquid or frozen drinks for human or animal consumption like vitamin and sports water; medicine for human or animal consumption such as anti-biotics; food stuffs such as meals, condiments like mayonnaise, mustard, etc., which may or may not be frozen; household items like shampoo, soap, toothpaste, etc.

Referring again to FIG. 1, the apparatus include a container 100 constructed from one of more flexible plastic sheets. The container comprises a number of connected bags. Each bag has a chamber 102 for holding material. Each chamber is separated from an adjacent chamber by a web of the flexible plastic sheet. The webs have perforations 104 that allow adjacent bags to be separated from one another. It is noted that the one or more flexible plastic sheets of container 100 are flexible to permit holding water or ice or other material within the chambers 102 without leakage. This represents an advantage over the rigid water bottles of the prior art, for example, which crack as water freezes and expands.

In the embodiment shown in FIG. 1, the chambers are arranged in a strip. A loop of flexible material 106 is attached to the container 100 to form a carrying handle. As show, the loop of flexible material has an extended portion 108 that passes down a first side of the container and up a second side of the container, such that, when the apparatus is carried, the weight of material in the chambers is supported, at least in part, by the loop of flexible material. In an alternative embodiment, the loop of flexible material is only connected to the bag at one end of the container.

The loop of flexible material may be removably attached to the container. For example, the loop could be attached to the container using a low strength adhesive that allows the loop to be 'peeled' from the container when it is no longer needed.

The container and the loop may be constructed of thermoplastic. In one embodiment, the container is constructed of puncture resistant, polyethylene film and does not contain bisphenol-A; it is noted that in the case where the materials transported and/or stored in such containers are those for food consumption or medical use, the materials and their compositions may require food and/or drug regulatory approval. Non-biodegradable materials provide the advantage of being easy to collect and recycle for future use. Biodegradable materials may also be used and are especially attractive for short-term use in keeping with current "green" efforts. The chambers may be formed by heat sealing the periphery of the bag. Various types of heat sealing are known to those of ordinary skill in the art, these include continuous heat-sealers (also known as Band type heat sealers), impulse heat sealers that use a stationary element which is heated with each sealing cycle, hot bar sealers, and ultrasonic welders. Other methods of manufacture will be apparent to those of ordinary skill in the art.

The loop may be welded to the container and may be perforated at intervals to allow adjacent bags to be separated from one another.

The plastic sheet 110 forming a corner of each of the bags may be removable so as to allow material, such as liquid water or the like to be removed from the chamber. The corner may be partially notched or slit to facilitate tearing off the corner.

The number of chambers may be varied. The chambers may be arranged in a strip, as shown, or in a two-dimensional array.

Figure 2:
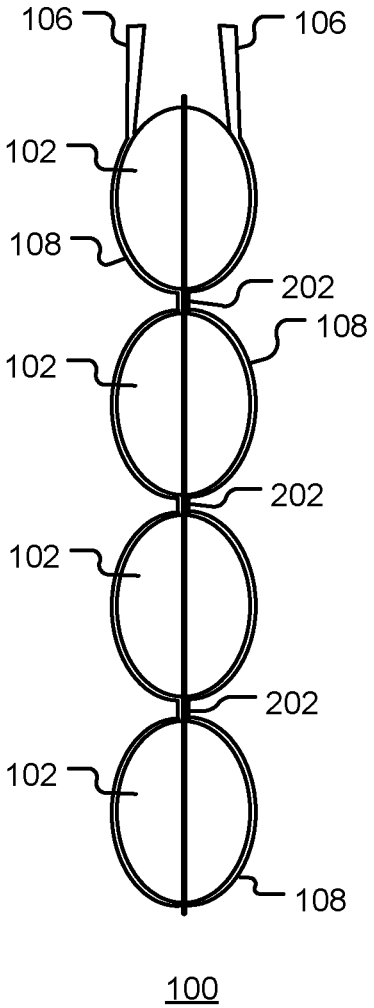
FIG. 2 is a second view of an exemplary container in accordance with some embodiments of the invention.

FIG. 2 is an exemplary side view of the apparatus shown in FIG. 1. This view shows the chambers 102 for holding material. The chambers 102 are separated by a web of material 202 that is perforated so as to allow the chambers to be separated from one another. In this embodiment, the flexible loop 106 includes a lower portion 108 that passes under the lower chamber and extends up both sides of the container to form a carrying handle as shown in the drawing. In this embodiment the flexible loop 106 is attached to all of its length apart from the carrying loops.

Figure 3:
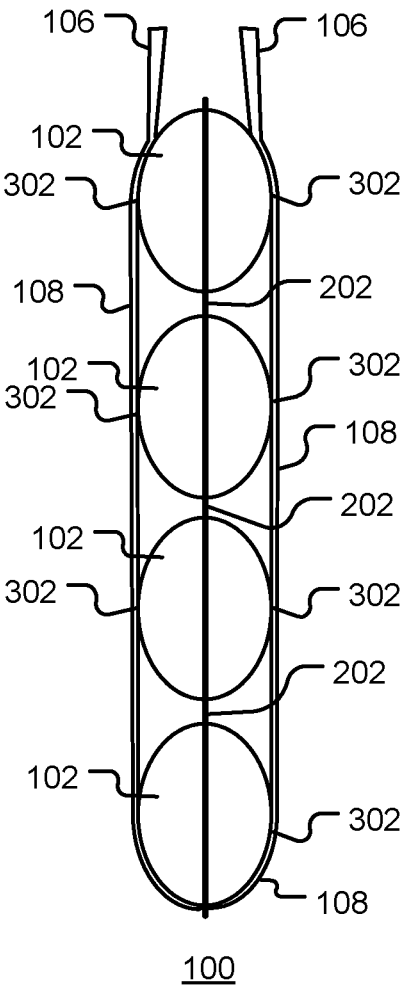
FIG. 3 is a further exemplary container in accordance with some embodiments of the invention.

FIG. 3 shows a further embodiment in which the extension 108 of the flexible loop is attached to the container at intervals, such as discrete locations 302.

Figure 4:
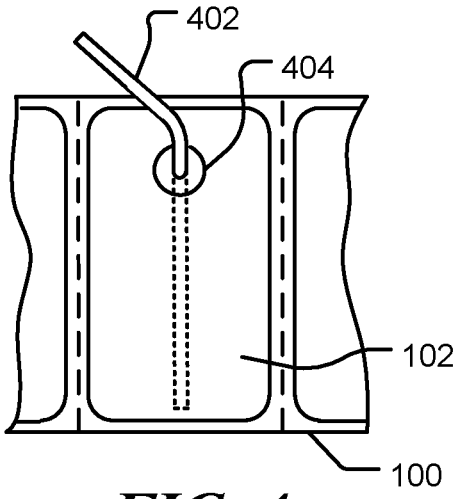
FIG. 4 shows an exemplary container with a drinking straw in accordance with some embodiments of the invention.

FIG. 4 shows an embodiment in which a drinking straw 402 is embedded in a wall of each of the chambers 102. The straw 402 may have a valve or a snap-off end, so that material, like water may be removed from the chamber through the straw when required. The region 404 of the chamber wall where the straw is embedded may be reinforced.

Figure 5:
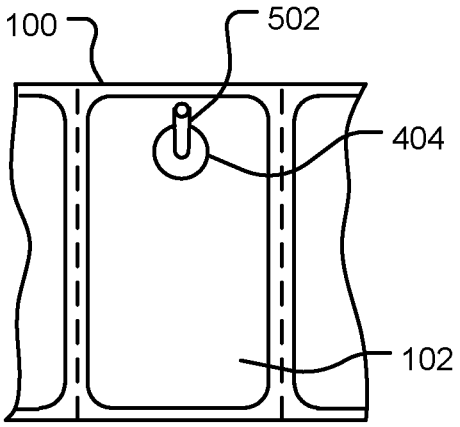
FIG. 5 shows an exemplary container with a drinking nozzle in accordance with some embodiments of the invention.

FIG. 5 shows a further embodiment in which a nozzle 404 is embedded in wall of each of the chambers 102. The nozzle may be equipped with a cap or a valve, for example, to prevent unintended leakage, and may be re-sealable. The region 404 of the chamber wall where the nozzle is embedded may be reinforced. The valve may be a one-way valve that allows liquid material, like water, medicines, etc., to escape when the valve is pinched. The valve may be constructed of rubber or a rubber-like material.

The apparatus may be used for distributing material in liquid form or in frozen form, such as ice. For example, when emergency relief is needed at a particular location there may be a need for both frozen (such as ice) and liquid (such as water) states of a material. Frozen material, like ice, may be needed for a variety of reasons, included the preservation of perishable foods and for personal cooling. The apparatus of the present invention is well suited to this application.

Figure 6:
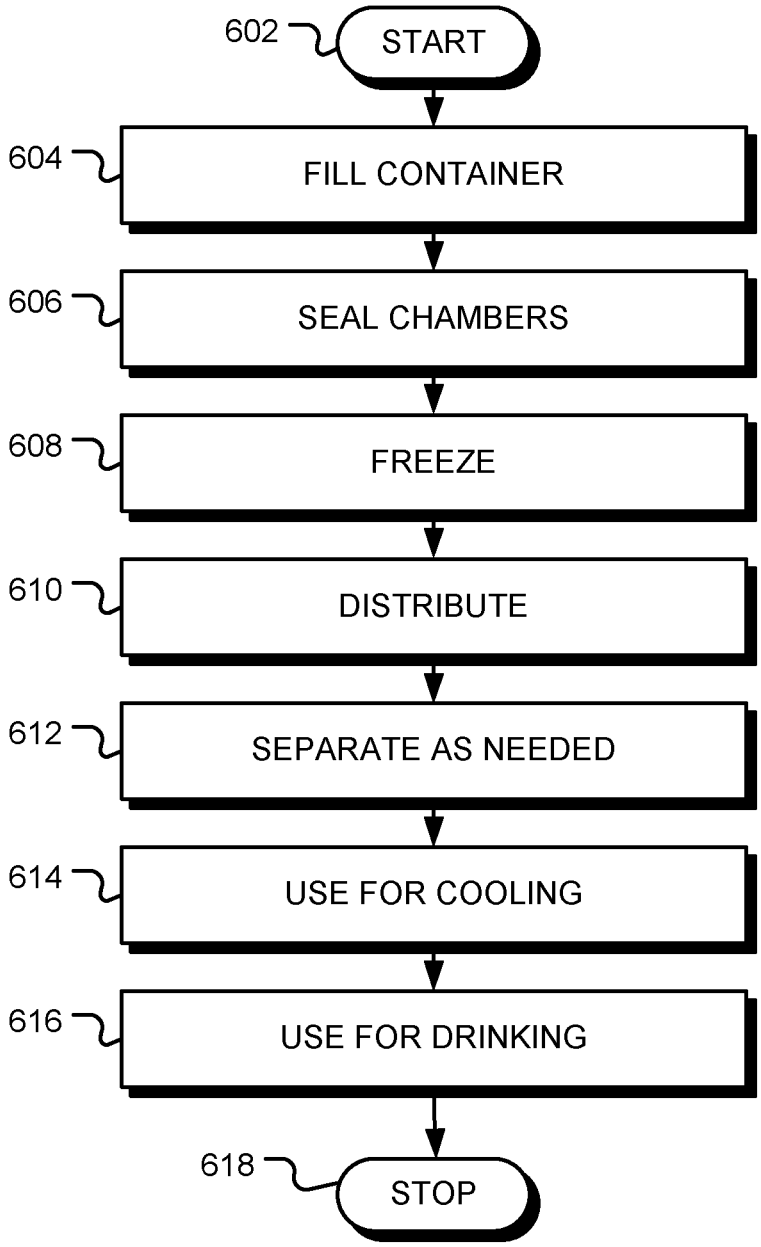
FIG. 6 is a flow chart of a method for material distribution in accordance with some embodiments of the invention.

FIG. 6 is a flow chart of a method for material distribution in accordance with some embodiments of the invention. Following start block 602 in FIG. 6, the chambers of the container are filled with liquid material, such as potable water, at block 604 and the chambers are sealed at block 606. At block 608, the material in the container is frozen. For example, this may be done before the container is transported to the region where emergency aid is required and distributed or while being transported in refrigerated vehicles, or at some other location. At block 610 the containers are distributed. They may be distributed complete, with multiple chambers and equipped with a carrying handle. Alternatively, one or more chambers may be separated prior to distribution. At block 612, the chambers are separated as needed by the user. Separation is facilitated by the perforations in the web separating the chambers. The frozen material may be used for cooling at block 614, such as for providing a cold compress if medically indicated. Once the frozen form of the material has melted, the liquid form of the material, i.e. water, may be used for drinking at block 616. In this way, both cooling and hydration needs are met. The method terminates at bock 618.

Figure 7:
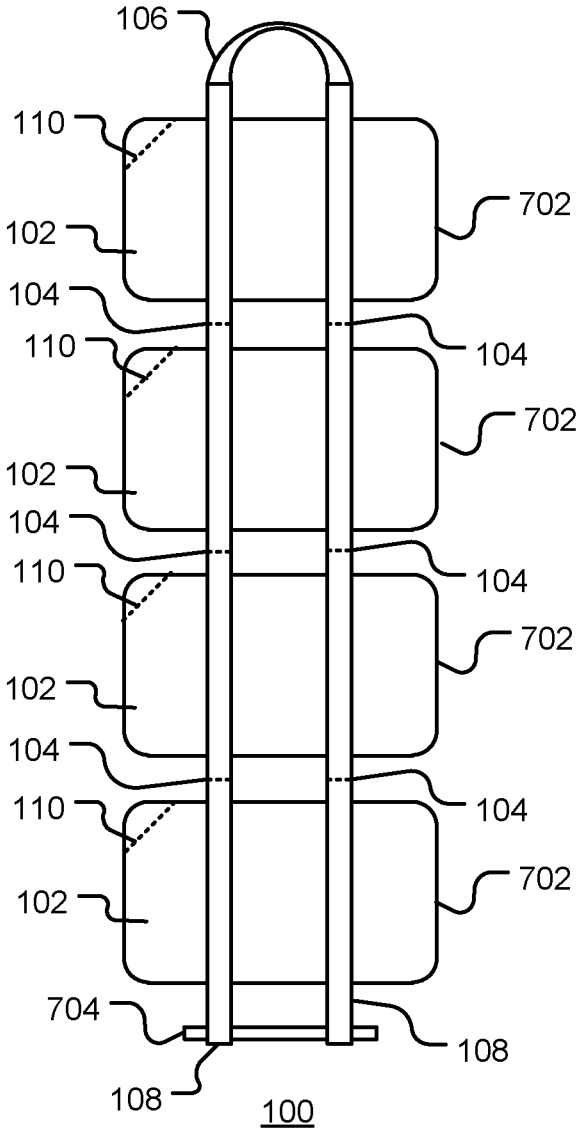
FIG. 7 shows a container for storage and transport in accordance with some further embodiments of the invention.

FIG. 7 shows a container 100 for storage and transport in accordance with some further embodiments of the invention. Referring to FIG. 7, the apparatus 100 comprises one or more flexible plastic bags 702 that form storage chambers 102. The bags 702 are coupled by one or more strips 108 constructed of a flexible material. The strip may have perforations 104 formed in the sections of strip between adjacent bags.

The plastic sheet 110 forming a corner of each of the bags 702 maybe removable so as to allow material to be removed from the chamber 102. The corner of the bag may be partially notched or slit to facilitate tearing off the corner.

A loop of flexible material 106 is attached to the container 100 at a first end to form a carrying handle. The loop 106 may be formed of the same material as the strip 108 and may be integral with it. A corresponding hook 704 may be attached to the other end of the container. The hook may take a variety of forms and is designed catch in the loop 106, so that the container forms a loop of connected bags. The loop of connected bags may be carried over a person's shoulder for facilitated transportation. In FIG. 7, the hook comprises a substantially rigid bar that may be pass through the loop 106, or used as an alternative carrying handle.

The bags 702 may be constructed of a biodegradable material.

Figure 8:
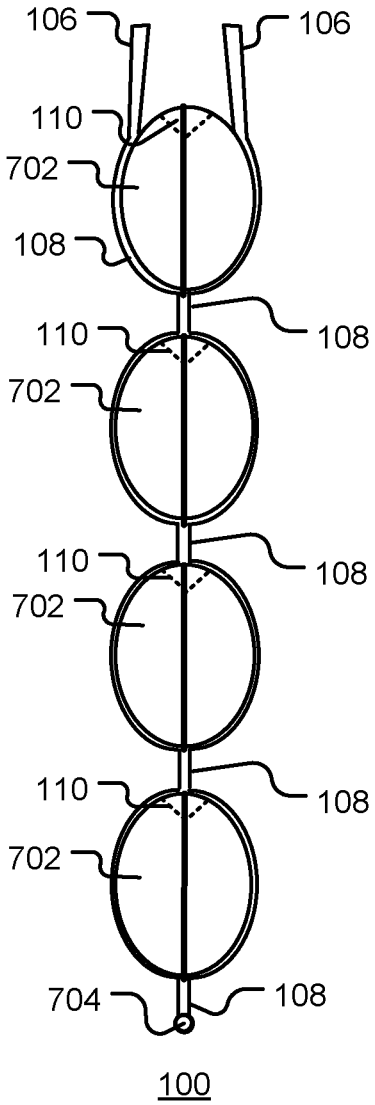
FIG. 8 is an exemplary side view of the apparatus shown in FIG. 7.

FIG. 8 is an exemplary side view of the apparatus shown in FIG. 7. This view shows the bags 702 for holding liquid or non-liquid material. The bags 702 are arranged side-by-side, or end-to-end, in a line and coupled by one or more strips of flexible material 108. The flexible material may be perforated so as to allow the bags to be separated from one another. Other ways of separating the bags will be apparent to those of ordinary skill in the art. These include strips that are notched for easy tearing, or strips that may be separated by peeling from one another or from the bag.

In the embodiment shown in FIG. 7 and FIG. 8, the flexible material includes a looped portion 106 that forms a carrying handle.

Figure 9:
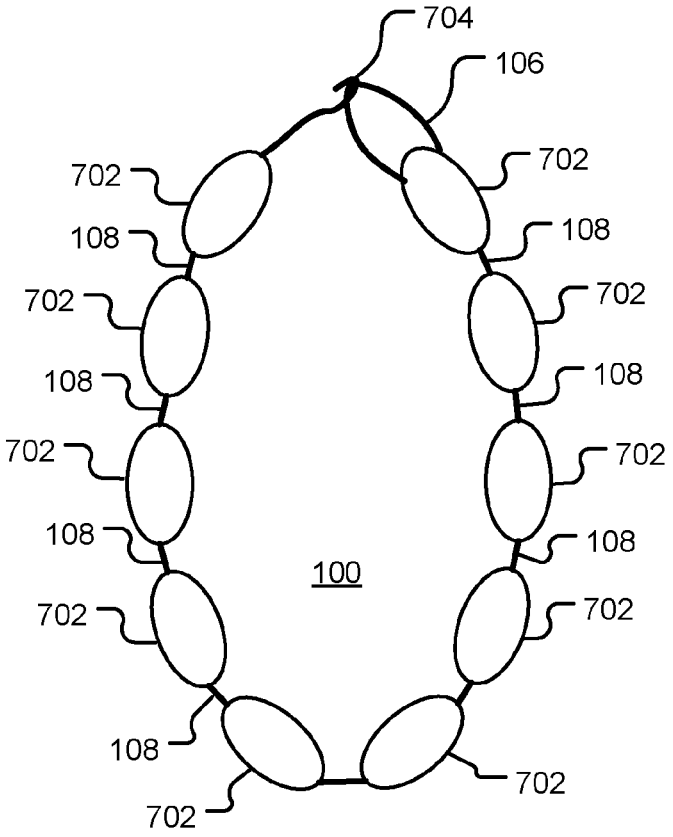
FIG. 9 shows a loop of connected bags in accordance with some embodiments of the invention.

FIG. 9 shows a loop of connected bags. A loop of flexible material 106 is attached to the container 100 at a first end to form a carrying handle. A corresponding hook 704 may be attached to the other end of the container. The hook 704 may take a variety of forms and is designed catch in the loop 106, so that the container forms a loop of connected bags, as shown in FIG. 9. The loop of connected bags may be carried over a person's shoulder for facilitated transportation.

Figure 10:
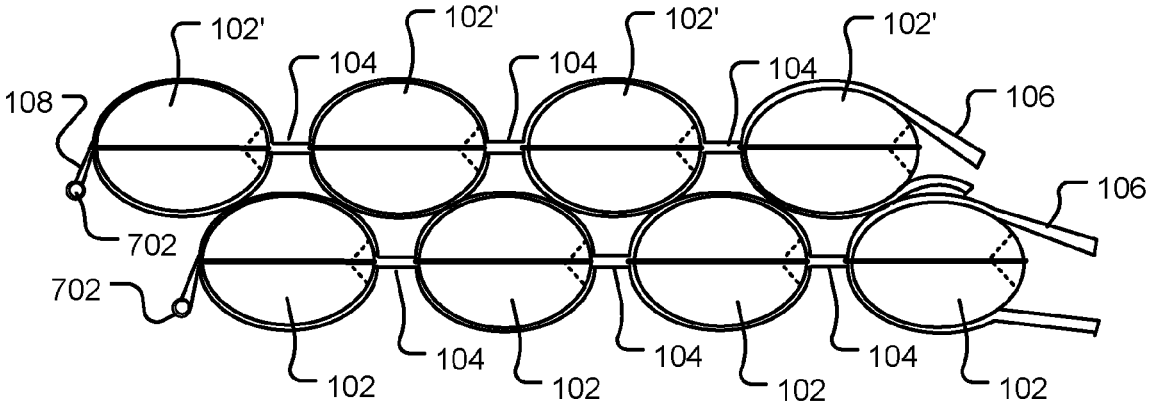
FIG. 10 shows a stack connected bags in accordance with some embodiments of the invention.

The bags may be spaced apart so as to facilitate stacking of bags. This is illustrated in FIG. 10. In FIG. 10, an upper group of four connected bags 102' is supported on top of a lower group of connected bags, 102. The upper bags are located in the gaps between the lower bags. In this manner, a stable stack of bags may be built. Multiple groups of connected bags may be stacked for storage or distribution.

Figure 11:
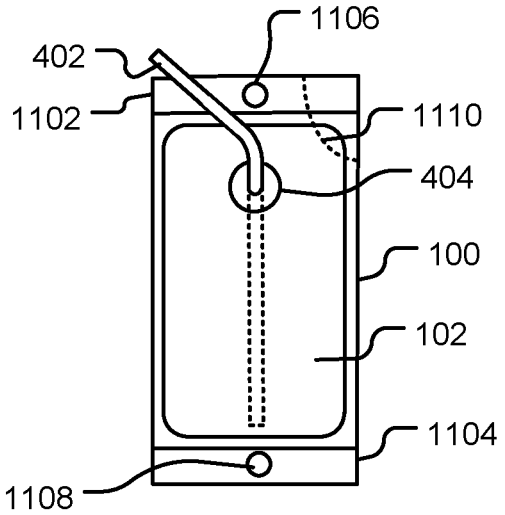
FIG. 11 shows an individual storage and transport container in accordance with some embodiments of the invention.

FIG. 11 shows an individual material storage and transport container 100 in accordance with some embodiments of the invention. The container comprises a plastic bag with a reinforced top portion 1102 and a reinforced lower portion 1104. Material, such as water or ice, may be contained in the interior volume 102. In one embodiment, the interior volume is sized to contain approximately 20 fluid ounces of water or other liquid material, but other sizes may be used. The reinforced portions may contain holes 1106 and 1108. These holes enable the bag to be supported by or joined by a hook, for example. A corner of bag may include a tear-off region 1110 that may be removed to allow material to be removed from the bag. Alternatively, a retractable straw 402 may be passed through a reinforced insert region 404 to allow liquid material like water to be removed from the bag.

Figure 12:
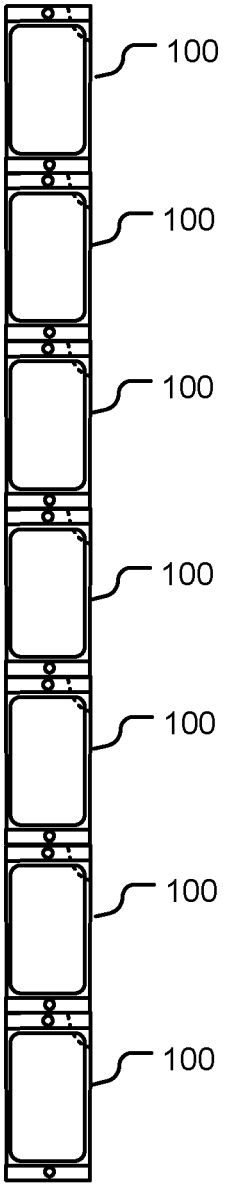
FIG. 12 shows a strip of connected storage and transport containers in accordance with some embodiments of the invention.

FIG. 12 shows a strip of connected material storage and transport containers in accordance with some embodiments of the invention. The bags 100 are coupled by adjacent reinforced regions. The reinforced region may be perforated to allow the bags to be easily separated from one another. Having the bags joined together facilitates movement and storage of the bags. The reinforced region may be formed by heat seal, embedded portions containing string material (twine, burlap) that could be glued or sewn or embedded or heat-sealed to provide structural strength and reinforcement for larger bags of material, such as a liter of water that can weigh approximately two pounds each bag, or more. The embedded portions of string material may be of sufficient strength to allow multiple bags to be connected together. For example, 12 1-liter bags of water formed together may be quite heavy, requiring additional structural support. The strip of connected storage and transport containers may be formed or manufactured as a unitary, circular strip, having no discernable beginning or ending. This would have the advantage of allowing a person to transport multiple bags circularly formed over the shoulder, about the waist, etc. For example, it is noted that a person could carry two or more loops or strips of thus connected containers, one over each shoulder hanging straight down from the should or in a cross-body position. A portion of each of the loops thus carried could then be temporarily joined together between the carrier's shoulder blades or in the front of the person to make transport of multiple strips easier. Hooks, clips or the like could be used to removably and temporarily attach the multiple strips of containers together.

Figure 13:
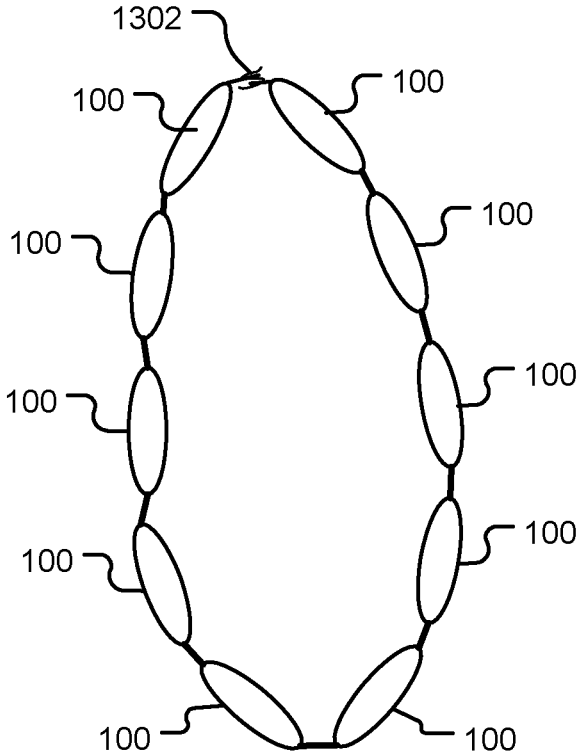
FIG. 13 shows a strip of connected storage and transport containers, joined in a loop in accordance with some embodiments of the invention.

FIG. 13 shows a strip of connected material storage and transport containers, joined in a loop in accordance with some embodiments of the invention. In this embodiment, the reinforced regions of the first and last bag are joined by a hook 1302, which is shown in more detail in FIG. 14. Having the bags joined in a loop facilitates allows a person transporting to carry multiple bags looped over their shoulder. It also allows the loop of bags to be placed over an object such as a door, wall, or post.

Figure 14:
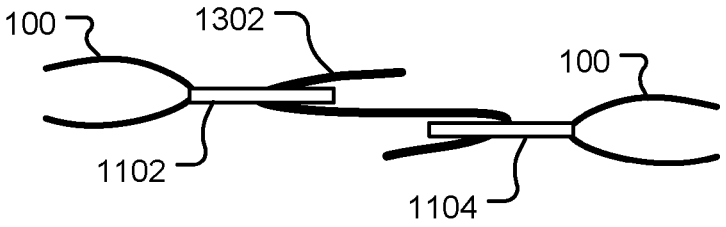
FIG. 14 shows an exemplary hook for connecting containers in a loop.

FIG. 14 shows an exemplary hook for connecting material containers in a loop. In this example an 'S' shaped hook is used, although other shaped hooks may be used. Indeed, other methods of the joining the ends of the strip of bags may be used without departing from the current invention. Moreover, in the event of individual material containers, a top side of a container may employ a grommet, ring hole or the like for fastening it individually from an individual hook of a stand, such as that a number of containers so attached to the stand may resemble fish hanging from a fish hook stand.

Figure 15:
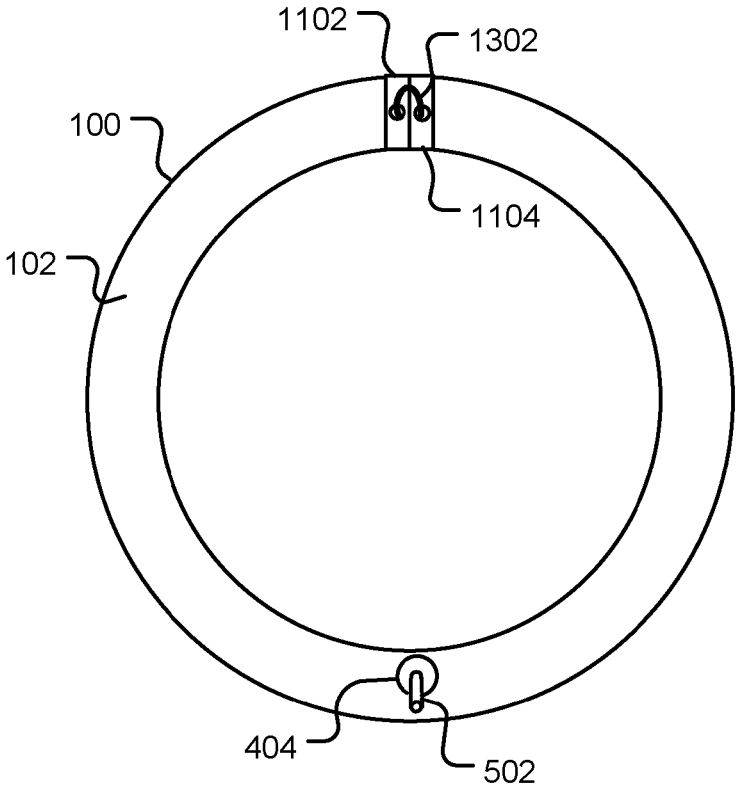
FIG. 15 shows a single, elongated storage and transport container in accordance with some embodiments of the invention.

FIG. 15 shows a single, elongated water storage and transport container 100 in accordance with some embodiments of the invention. In one embodiment, the interior volume of the container 100 is sized to contain approximately 1 liter of fluid material, like water. The ends of the container include reinforced regions 1102 and 1104. These ends may be joined by a hook or other connector 1302 that passes through holes in the reinforced regions. As described above, this allows the container to be formed into a loop for easy transportation by a person. When the hook is removed, the bag may be laid flat for storage.

In one embodiment, liquid material may be removed from the container 100 through a pinch spout 502 that passes through a reinforced region 404 of the wall of the container 100.

Figure 16:
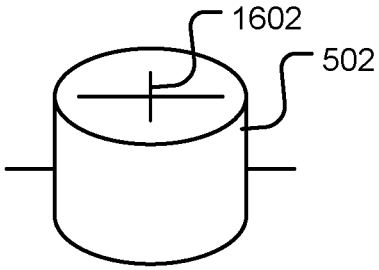
FIGS. 16 and 17 show an exemplary pinch spout for use with storage and transport containers.
Figure 17:
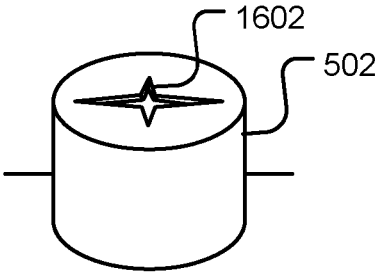

FIGS. 16 and 17 show an exemplary pinch spout for use with material storage and transport containers. Referring to FIG. 16, the end of the pinch spout 502 includes one or more slits 1602 that are held closed by the elasticity of the material from which the spout is manufactured. This prevents liquid material, like water, from escaping. To remove liquid material from the pinch spout, the user pinches the spout by applying pressure to the sides of the spout. This causes the sides of the slits to separate, as shown in FIG. 17, allowing liquid material to escape. The pinch spout may be covered with a substantially rigid cap to prevent accidental pinching of the spout and to keep the spout clean. Moreover, the container having a pinch spout may be augmented by a second tap for re-filling the container with material.

Other methods of removing material from the container 100 will be apparent to those of ordinary skill in the art.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An apparatus for storage and transport of material, comprising:

a plurality of bags, each constructed from one or more flexible plastic sheets and forming a chamber for holding material, the chamber having an inner chamber surface and an outer chamber surface and each plastic sheet of the one or more flexible plastic sheets having a front surface that forms the outer surface of the chamber, a back surface that forms the inner surface of the chamber, and at least one edge surface; and at least one strip of flexible material attached to each bag of the plurality of bags;

where, for each bag of the plurality of bags, the at least one strip of flexible material overlays a first region of a front surface of a flexible plastic sheet that forms the outer chamber surface of the bag, wherein each bag of the plurality of bags is coupled to an adjacent bag by the at least one strip of flexible material, wherein the at least one strip of flexible material is configured to support the weight of any material in each bag of the plurality of bags during transport, wherein the plurality of bags are arranged edge to edge in a line, and wherein a strip of flexible material of the at least one strip of material is removably and directly coupled end-to-end, such that the strip of flexible material forms a loop and the line of bags is arranged in a loop.

2. An apparatus in accordance with claim 1, wherein the at least one strip of flexible material is perforated to allow adjacent bags of the plurality of bags to be separated from one another.

3. An apparatus in accordance with claim 1, wherein the plurality of bags are spaced apart to facilitate stacking of bags, with spacing from center line to center line of adjacent bags of the plurality of bags being spaced greater apart than a diameter of a single full bag of the plurality of bags.

4. An apparatus in accordance with claim 1, wherein the at least one strip of flexible material is removably attached to the bag.

5. An apparatus in accordance with claim 1, wherein the plastic sheet that forms a corner of each of the plurality bags is removable to allow material to be removed from the bag.

6. An apparatus in accordance with claim 1, further comprising a drinking straw, embedded in a wall of each of the plurality bags, which allows material to be removed from the bag.

7. An apparatus in accordance with claim 1, further comprising a sealable nozzle, embedded in a wall of each of the plurality bags, the sealable nozzle enabling material to be removed from the bag.

8. An apparatus in accordance with claim 1, further comprising a valve, embedded in a wall of each of the plurality bags, which allows material to be removed from the bag when the valve is pinched.

9. An apparatus in accordance with claim 1, wherein the one of more flexible plastic sheets are constructed of a biodegradable material.

10. An apparatus for material storage and transport comprising:

one or more flexible plastic sheets joined to form a first bag comprising:

a first chamber for holding material;

a first reinforced region forming a first end of the first chamber, the first reinforced region formed by the one or more flexible plastic sheets; and a second reinforced region forming a second end of the first chamber, opposite the first end of the chamber, the second reinforced region formed by the one or more flexible plastic sheets;

a first hole formed in the first reinforced region;

a second hole formed in the second reinforced region;

a connector that passes through the first and second holes to directly connect the first reinforced region to the second reinforced region such that the one or more flexible plastic sheets that form the first chamber form a loop of sufficient length to be looped over a shoulder of a person to facilitate transportation of the apparatus; and a removal element for removing material from the first chamber, where at least one of the first and second reinforced regions contains embedded material to provide structural strength and reinforcement.

11. An apparatus in accordance with claim 10, wherein the removal element for removing material from the first chamber comprises a means selected from the group consisting of:

a pinch spout;

a valve;

a retractable straw; and a tear-off region.

12. An apparatus in accordance with claim 10, wherein the chamber is elongated and sized to contain approximately 1 liter of liquid material.

13. An apparatus in accordance with claim 10, the connector being a hook that passes through the first and second holes to removably and directly connect the first reinforced region to the second reinforced region to form the self-forming loop.

14. An apparatus for material storage and transport comprising:

one or more flexible plastic sheets joined to form a first bag comprising:

a first chamber for holding material;

a first reinforced region forming a first end of the first chamber, the first reinforced region formed by the one or more flexible plastic sheets; and a second reinforced region forming a second end of the first chamber, opposite the first end of the chamber, the second reinforced region formed by the one or more flexible plastic sheets;

a first hole formed in the first reinforced region;

a second hole formed in the second reinforced region;

a removal element for removing material from the first chamber; and where at least one of the first and second reinforced regions of the first bag contains embedded material to provide structural strength and reinforcement, where the first bag has a ring shape, and where the first and second reinforced regions occupy adjacent regions of the ring-shaped first bag such that they may be coupled using a connector that passes through the first and second holes.

15. An apparatus in accordance with claim 14, further comprising a connector that passes through first and second holes of first and second reinforced regions of the first bag.

16. The apparatus of claim 10, where the embedded material comprises string material.

17. The apparatus of claim 10, where at least one of the first and second reinforced regions is heat-sealed.

18. The apparatus of claim 10, where the first and second reinforced regions are configured to have structural strength to support at least 1 liter of water.

* * * * *